United States Patent [19]

Twyford

[11] Patent Number: 4,600,819

[45] Date of Patent: Jul. 15, 1986

[54] SWITCH ASSEMBLY

[75] Inventor: Robert H. Twyford, Great Falls, Va.

[73] Assignee: Mechanical Enterprises, Inc., Herndon, Va.

[21] Appl. No.: 708,295

[22] Filed: Mar. 8, 1985

[51] Int. Cl.[4] ..... H01H 13/52; H01H 15/00; H01H 1/02; H01H 1/06

[52] U.S. Cl. ..... 200/16 A; 200/159 R; 200/264; 200/276

[58] Field of Search ..... 200/16 R, 16 A, 159 R, 200/239–243, 264, 276, 61.44

[56] References Cited

U.S. PATENT DOCUMENTS

| | | | |
|---|---|---|---|
| 3,725,625 | 4/1973 | Pratt | 200/276 X |
| 3,895,203 | 7/1975 | Le Worthy | 200/276 |
| 3,924,089 | 12/1975 | Abernathy | 200/264 X |
| 4,188,518 | 2/1980 | du Temple de Rougemont | 200/159 R |
| 4,203,016 | 5/1980 | Twyford | 200/276 X |
| 4,242,546 | 12/1980 | Alonso | 200/264 X |
| 4,295,699 | 10/1981 | Du Rocher | 200/264 X |
| 4,418,252 | 11/1983 | Daigle | 200/276 X |
| 4,473,727 | 9/1984 | Beck | 200/276 X |

FOREIGN PATENT DOCUMENTS

| | | | |
|---|---|---|---|
| 2113920 | 8/1983 | United Kingdom | 200/264 |

*Primary Examiner*—J. R. Scott

*Attorney, Agent, or Firm*—Fleit, Jacobson, Cohn & Price

[57] ABSTRACT

A switch assembly particularly suitable for electrical keyboard applications includes a pair of wire conducting members disposed in substantially collinear relationship on a supporting base and defining a pair of switch contact surfaces disposed radially outward from the circumference of the wire conducting members. In one embodiment, surrounding the exterior of the collinearly disposed wire conducting members, and spaced from and in facing relationship with the contact surfaces thereof, lies a cylindrical or tubular contactor member. The contactor member may include a closely-wound electrically conductive wire. The contactor member is supported in spaced apart position by a resilient sealing tube which encloses the end portions, including the contact surfaces, of the wire conducting members. A spring biased actuating force is provided to move the sealing tube and contactor member into engagement with the contact surfaces. The spring force is provided by a rubber-like spring member disposed adjacent to the sealing tube and deformable, or deflectable, laterally into force transmitting engagement with the sealing tube to cause the switch to close. In another embodiment, cylindrical conductive rubber sleeves are fitted upon the wire conducting members and the spring member is likewise formed of conductive rubber. In still another embodiment, the spring member includes a conductive rod that contacts the wire conducting member directly.

29 Claims, 9 Drawing Figures

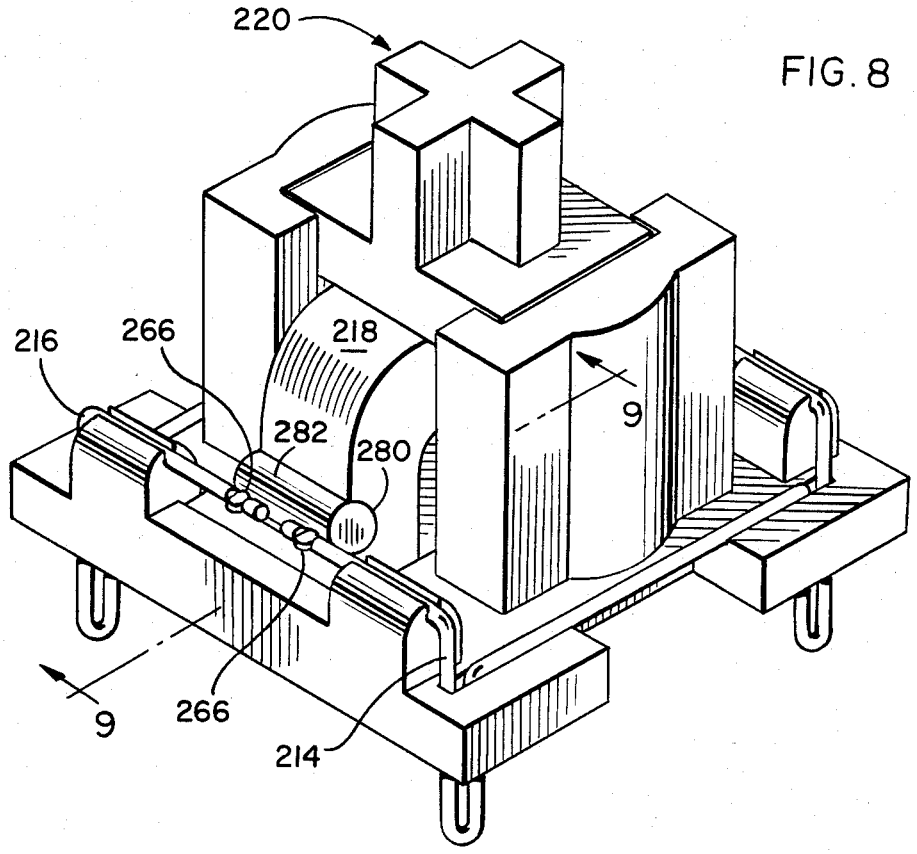
FIG. 8
FIG. 9
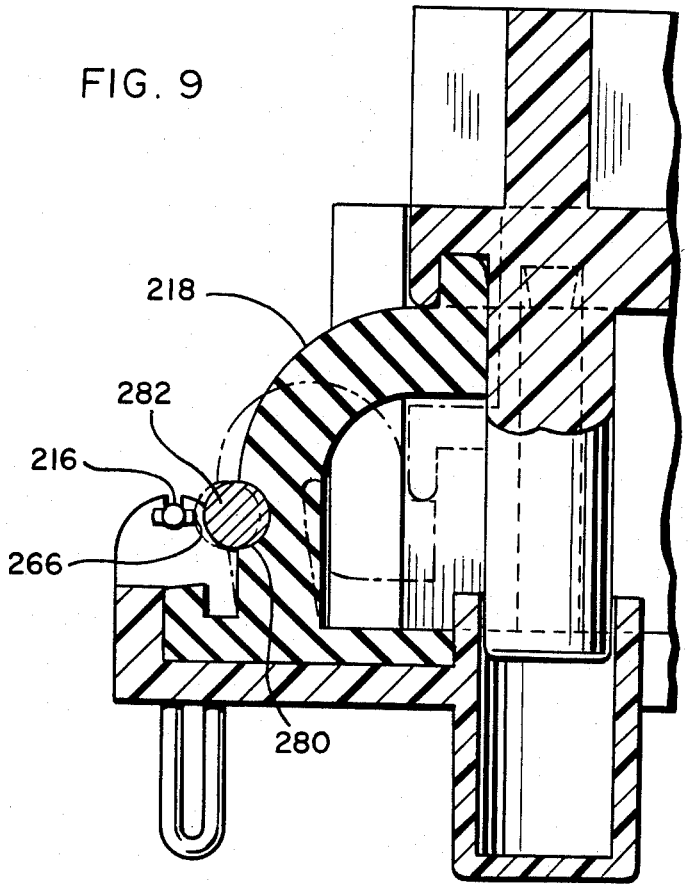

SWITCH ASSEMBLY

BACKGROUND OF THE INVENTION

This invention relates generally to switch assemblies including miniaturized switch assemblies which are frequently employed in keyboards for controlling electronic equipment involving low voltage and low current use application.

A multitude of keyboard applications exist wherein keys or push buttons on a keyboard effect actuation of switches that are integrated into electronic circuits for carrying out a variety of computer or data processing operations. These range from keyboard applications in pocket calculators to both local and remote computer terminals. The cost of such keyboards is indeed a significant factor when the substantial number of terminals, input devices and other peripheral equipment uses in computer and data processing applications are considered. Further, large volume demand for miniaturized electrical switches occurs in solid state adding machines and calculators embracing desk top models ranging down to small pocket size calculators.

A variety of switch constructions suitable for keyboards of the types mentioned above have been developed in a wide range of both mechanical-electrical configurations and elaborate electronic switching concepts. Particularly, in the miniaturized switches needed for the very small and now low cost pocket size calculators, the large volume of keyboards needed makes cost in the keyboard construction a critical factor. Thus, the miniaturized switches must involve a low initial investment, be maintenance free in operation and possess high operational reliability. Meeting all of these criteria has indeed been a major problem in the development of miniaturized electrical switches.

One type of switch assembly suitable for keyboard type applications is described in U.S. Pat. No. 4,433,317, issued to the same applicant as the instant invention. The preferred embodiments disclosed in such patent provide for a pair of switch contact members formed of rod-like members that are precisely mounted in a housing cavity wherein the ends of the contact members are spaced to provide opposed contact surfaces. The contact surfaces are defined to be within an area bounded by the periphery of the contact rod member ends. A floating contactor member is disposed between the contact surfaces. The contactor member and contact rod ends are enclosed by a resilient sleeve which protects the switch from contamination, provides a centering, or return, force to maintain the switch in an open condition, and absorbs excessive operating forces. Operating forces are applied through the resilient sleeve by a trigger element associated with the switch housing.

The preferred embodiments disclosed in U.S. Pat. No. 4,433,317 satisfy many of the objectives of a miniaturized switch for keyboard-type applications. However, because the contact surfaces are within an area bounded by the periphery of the ends of the contact rods, the contact surfaces and the floating contactor member must be situated relative to one another in a precise manner. For example, the alignment between the opposed contact members is relatively critical, as is the spacing between these contact surfaces. Moreover, the contactor member configuration, such as the floating ball contactor, must be precisely manufactured. Deviations from the relatively precise design requirements will result in a switch that either shorts prematurely or is incapable of closing in its intended manner. Such precise manufacturing and assembly adds to the cost of the finished product.

Moveover, since the contact surfaces of the switch embodiments disclosed in U.S. Pat. No. 4,433,317, are defined to be within an area bounded by the periphery of the contact members, such as within the periphery of the opposed faces of the contact member rod ends, the contact member must be of relatively substantial diameter to permit shaping of the contact surfaces (such as the preferred conical shape). As such, the contact members are rod-like, as opposed to relatively thin wire, which adds to the cost of manufacture. Further, such rod-like members may transmit accidental forces that may be applied, for example, to the terminal ends, which may distort the relative spacing between the contact surfaces and the contactor member.

Still further, the preferred embodiments disclosed in U.S. Pat. No. 4,433,317, include a trigger element that is preferably formed of a relatively hard molded plastic and which includes a pressure finger to provide a force to the resilient sleeve at a relatively localized area on the sleeve. This may result in undesirable sleeve wear.

SUMMARY OF THE INVENTION

The novel switch assembly of the present invention provides for a pair of switch contact members to be secured to a base in spaced-apart relationship, substantially collinear to each other, whereby each contact member is an electrical conductor having a contact surface facing in an outward direction from the circumference of the conductor. The switch contact members are preferably formed from relatively thin wire having contact surfaces physically displaced from the wire circumference. An elongated contactor member, having a length at least as great as the distance between the contact surfaces, is disposed in surrounding relationship to the contact surfaces, and spaced therefrom, such that the interior surface of the contactor member overlies or faces the contact surfaces. The contactor member is preferably cylindrical, or tubular, and is supported by a resilient sealing sleeve that encloses the spaced apart ends of the wire contact members, including the contact surfaces thereon. By providing outwardly-facing contact surfaces from the circumference, or periphery, of the contact members, the contact surface areas are not limited by, or confined to, the cross-sectional area of the contact members. Moreover, the cylindrical, or tubular, contactor member can be sized so as to ensure a sufficient spacing between the contactor member and the contact surfaces to enable proper switch operation even if the conducting members are inexactly aligned or the geometry of the contactor tube is slightly misshapen.

The switch of the present invention may be mechanically operated by a novel switch actuator defined by a resilient spring that is positioned adjacent to the sealing sleeve. Preferably, the resilient spring is a rubber-like strip of material having a planar face lying substantially parallel with the resilient sleeve. The rubber-like strip is coupled to a reciprocally-mounted plunger which distorts or deflects the rubber-like strip into force transmitting contact with the resilient sealing sleeve to cause the sleeve, with the contactor member disposed therein, to move into bridging contact with the contact surfaces. The rubber-like strip transmits force through the resilient sleeve over a substantial surface area, thus avoiding damage to the sleeve. Further, the rubber-like actuating strip assists in providing a return force to open the switch contacts when the application force is removed. Still further, the rubber-like strip assists in dissipating excessive mechanical actuating force, which might otherwise be applied directly to the switch contacts.

An additional embodiment of the present invention provides for the spaced-apart wire conducting members to include, at the ends thereof, a pair of resilient, electrically-conductive cylindrical sleeves, such as conductive rubber sleeves. In this embodiment, the actuating spring may be formed of a resilient electrically-conductive material, or, alternatively, may include a conductive metallic bridge member. Actuation of the switch results in lateral deflection and deformation of the actuating spring so that the conductive portion of the spring moves into contact with the conductive rubber sleeves to thus close the switch.

A further embodiment of the present invention provides for the spaced-apart wire conducting members to define contact surfaces on their outer peripheral surfaces, wherein the actuating spring includes a resilient rubber-like material that includes an electrically-conductive portion to bridge the contact surfaces of the wires when the spring is actuated. The electrically-conducting portion of the spring may include a metallic element embedded in the spring surface, or may be defined by a planar surface of an electrically-conductive rubber material.

The present invention further provides for the pair of wire conducting members to be supported by a substantially planar base wherein each wire member extends through the base in at least two distinct locations to form at least two coupling terminals for each contact for connection with a printed circuit board. As such, the switch is mounted to the circuit board by four terminals to provide a secure connection. Moreover, the four terminals increase the topographic electrical connecting options on the printed circuit board.

It is thus an object of the instant invention to provide a very low-cost, easily manufactured and assembled, yet highly reliable switch characterized by a long life and incorporating a minimum of required parts.

It is an object of the instant invention to provide a switch having a pair of contact surfaces defined by, and facing radially outward from, the circumference of collinearly positioned conducting members, and having a switch contactor member surrounding the contact surfaces, whereby the manufacture and assembly of these components requires less precision and thus lower cost. Preferably the conducting members are relatively thin conductive wires.

It is also an object of the invention to enclose the active switch components in a resilient sleeve, through which the switch actuating force may be transmitted, whereby the sleeve is capable of dissipating excess actuating force without unduly forcing the switch contact members into closing engagement with each other. The resilient sleeve also serves to protect the switch contacts and the contactor member from exposure to deleterious atmospheric or environmental conditions which could promote corrosion or other damage to the contact members and diminish the life expectancy for the switch. In addition, the resilient sleeve serves to return the switch to an open position when the switch actuating force is removed.

Still further, it is an object of the invention to provide a switch having an actuator member formed of a rubber-like spring element that is positioned adjacent to the switch contacts and which is deformable, or laterally deflectable, into engagement with the switch sleeve to move the sleeve, and the contactor member disposed therewithin, into a switch closing position. The rubber-like spring member provides less wear on the resilient sleeve and aids in returning the switch to an open position when the actuating force is removed. The rubber-like spring member also serves to dissipate any excess actuating force which may be applied.

Still further, it is an object of the present invention to provide a switch assembly for mounting on a printed circuit board wherein each contact member is configured to extend through a substantially planar base in at least two distinct positions to provide two contact terminals for each switch element, whereby providing a secure connection to the circuit board and increasing the number of electrical contact points on the printed circuit.

The foregoing objects, as well as others, will become apparent from the detailed description as described below.

BRIEF DESCRIPTION OF THE DRAWINGS

FIG. 8 is a perspective view of an additional switch assembly embodiment.

FIG. 9 is a partial section view on line 8—8 of FIG. 8.

DETAILED DESCRIPTION OF PREFERRED EMBODIMENTS

Figure 1:
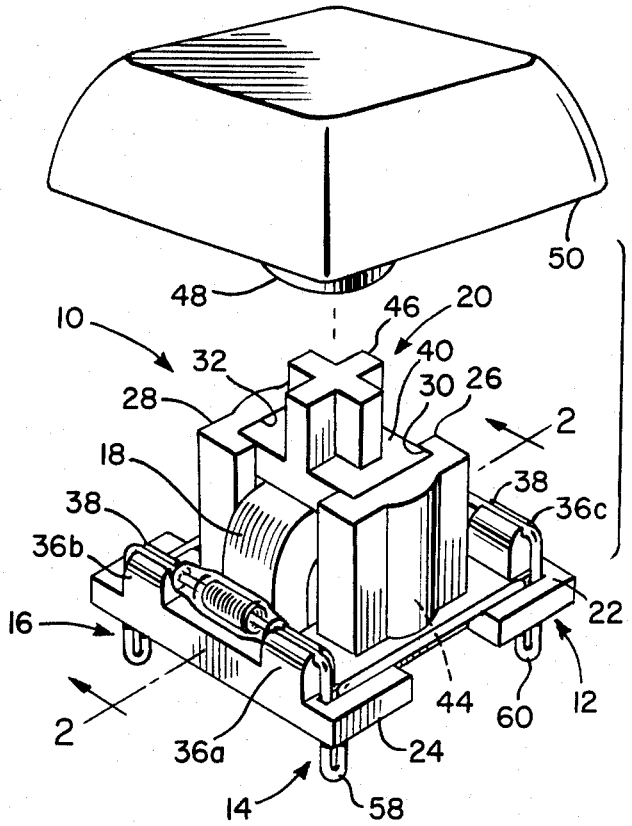
FIG. 1 is a perspective view of the switch assembly.
Figure 5:
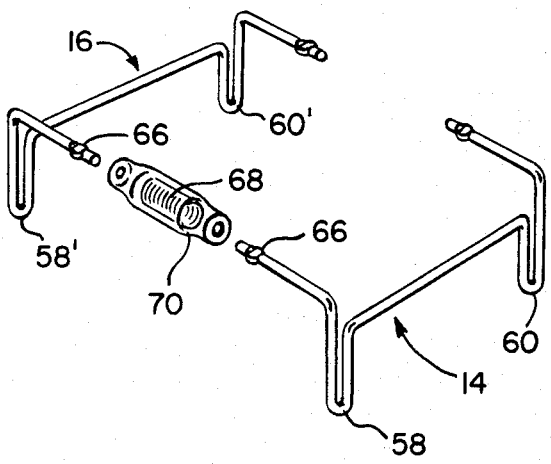
FIG. 5 is a perspective view of the wire conducting members, cylindrical contact member and resilient sleeve.

The switch 10 of the instant invention is formed by a supporting base 12 that supports a pair of conducting members 14, 16, a switch actuating spring 18, and a switch actuating plunger 20. The supporting base 12 is of non-conducting material, such as hard plastic, and preferably formed by an injection molded component. The supporting base 12, as shown in the preferred embodiment, includes a substantially planar top surface 22 and a substantially planar bottom surface 24. A pair of upstanding plunger guideways 26, 28 extend from the top planar surface 22. Each plunger guideway includes guideway notches 30, 32 to accommodate the plunger 20. Extending from the lower planar surface 24 is a cylindrical hollow rod guideway 34, centrally located from the lower planar surface to accommodate a locator rod 52 associated with the plunger 20.

A plurality of retaining bosses **36*a*–36*d* extend from the top planar surface 22 adjacent opposite edges of the planar base 12. The bosses 36 include elongated notches 38 to securely accommodate and retain the wire conducting members 14, 16. The bosses 36*a*–36*d*** are spaced apart from each other a sufficient distance to accommodate the active switch contact components.

The plunger 20 is reciprocally mounted to the base 12 within the upstanding guideways 26, 28. The plunger 20 is manually actuatable for movement substantially perpendicular to the planar base surface 22. The plunger 20 includes a plunger guide element 40 of substantially rectangular configuration to be slidably mounted within the guideway notches 30, 32. A stop ledge 42 extends from opposite sides of the plunger guide 40 to ride in a vertical slot 44 formed centrally in the guideways 26,28, which slot is discontinued to provide a stop surface (not shown) to retain the plunger within the guideways 26,28. Upstanding from the top surface of the plunger guide 40 is a cross-shaped male key element 46 which is adapted to fit within a corresponding female keyway 48 of a keytop element 50. Extending substantially perpendicular from the bottom surface of the plunger guide is a locator rod 52 which extends through a hole 54 defined by the base 12 into the cylindrical hollow rod guideway 34. The bottom surface of the plunger guide 40 is notched at 56 to accommodate the end of the spring 18 in a manner to be described.

It should be apparent that the precise shape and configuration of the supporting base 12 may be varied depending upon the particular environment that the switch is to be used, it being required only that the base be of non-conducting material and able to retain and support the various switch elements in their operative position as will be described.

Each of the conducting members 14, 16 are preferably formed of thin electrically conductive wire, for example, wire having a diameter of 0.018 inch. (For certain applications, the conducting members 14, 16 may be formed of rod-like members, however, such rod-like members would not provide all of the advantages that the thinner, wire-like members provide.) Each wire conducting member 14, 16 is shaped, or bent, into a configuration as shown such that two intermediate portions 58, 60 (58', 60') of each wire may be extended through slots 62, 64 defined by the base 12 to form a pair of electrical terminals, or plugs, for insertion into a printed circuit board (not shown). As such, each wire conductor has two terminals extending through slots located adjacent the corners of the base 12. This provides a stable four-point connection with the printed circuit board and provides two contact points on the circuit board for each conducting member. As a result the circuit designer has at least two contact points for each switch contact, i.e., four contact points overall for the switch, which provides a greater number of connecting options in laying out the topography of the printed circuit board. Moreover, because the terminals 58, 60 are formed of relatively thin wire, they provide a resiliency, or springiness, that enables them to be biased apart slightly for a tight fit into the spaced-apart openings of the printed circuit board.

The wire conducting members 14, 16 form the switch contacts and are retained within the notches 38 of the bosses 36 such that the end portions of the conducting members are aligned substantially collinearly with respect to each other, in spaced apart relationship. Each wire conducting member defines a contact surface 66 which faces outward from the circumference or periphery of the wire conductor. The conducting surfaces 66 may be formed by swaging the wire conducting members adjacent to the wire ends. For example, the contact surfaces may be swaged a distance of, for example, 0.002 inches from the circumferential periphery of the wire. Preferably, the contact surfaces 66 are rounded slightly to reduce the contact surface area that engages the contactor element 68 when the switch is activated. By reducing the contact surface area, the contact pressure is higher which lessens any contact noise.

It should be apparent that the contact surface 66 could be formed or shaped by means other than swaging the end portions of the wire conductors. That is, the contact surface could be separately formed and then secured, or bonded to the wire conductor, by welding, soldering, or other manner. For example, the contact surface could be defined by an annular bead that slips over the end of the wire and is bonded into position. Moreover, in certain applications, the contact surface may not be displaced radially outward from the circumference or periphery of the wire conducting member, but, in fact, be defined by the periphery. The essential feature of the contact surfaces is that they face radially outwardly from, i.e., at the outside of the opposed wire conducting members.

The wire conducting members 14, 16 are of electrically conductive metal and may be suitably plated, particularly at the contact surface portions, to provide a good electrical connection when the switch is closed. The wire conducting members must be stiff enough so as not to be permanently deformed when an actuating force is provided to close the switch, yet, preferably, not be too stiff in the event an accidental force is applied, for example, to the terminal portions 58, 60 of the conducting members, which might cause the conducting members to significantly distort at the contact surface portions. That is, in the event an accidental force is applied to the terminal portion 58, the terminal portion 58 should bend and thus absorb the force rather than transmit the force to the end portion of the conducting members which might undesirably misalign the ends of the conducting members.

A contactor member 68 is positioned adjacent to, and spaced from the contact surfaces 66. The contactor member 68 is preferably cylindrical, or tubular, and surrounds the ends of the wire conducting members 14, 16 in facing relationship with each of the contact surfaces. Preferably, the contactor member is formed from a cylindrically wound wire, suitably plated to provide a good electrical contact. It should be apparent that the contactor member 68 might be a unitary solid cylindrical piece; however, it is difficult to plate the inner cylindrical surface of such member as opposed to a wound cylindrical wire which may be easily plated in advance of winding. The inner diameter of the cylindrical contactor member is substantially greater than the outer diameter of the wire conducting members. For example, in a typical application, the inner diameter of the cylindrical contactor member 68 is 0.032 inch, whereas the diameter of the wire conducting member 14, 16 is 0.018 inch, swaged out to define contact surfaces spaced apart a diameter of 0.022 inch. Generally, the inner diameter of the contact tube 68 should be sufficiently spaced from the contact surfaces 66 so as to accommodate slight deflections or misalignments if the wire conducting members 14, 16 are not exactly collinear.

Figure 4:
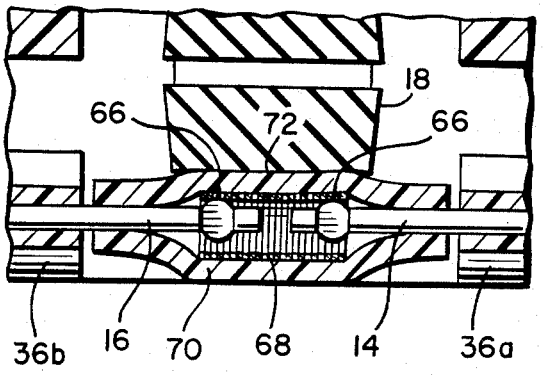
FIG. 4 is a section on line 4—4 of FIG. 3.

The cylindrical contactor member 68 is maintained and supported in a spaced apart relationship with respect to the contact surfaces of the wire conducting members by means of a sleeve 70 that surrounds and encloses the ends of the wire conducting members, including the contact surfaces thereof. The contactor member 68 is force-fit within the sleeve 70 to expand, or bulge, the sleeve (as best shown in FIG. 4) and is thus frictionally restrained within the sleeve 70 in its operative position in facing relationship with the contact surfaces 66. That is, the outer diameter of the cylindrical contactor member 68 is larger than the inner diameter of the sleeve 70. For example, a typical application might require the outer diameter of the contactor member 68 to be 0.042 inch and the inner diameter of the sleeve 70 to be 0.018 inch. This provides a tight frictional fit between the contactor member 68 and the sleeve 70 to maintain the contactor member in its operative position.

The sleeve 70 is preferably cylindrical or annular in cross-section, having a length along its major axis to fit within the bosses **36*a*–36*b* extending from the base 12. The sleeve 70 is preferably resilient and fits tightly about the wire conducting members 14, 16 to provide the advantages as discussed in U.S. Pat. No. 4,433,317. That is, the sleeve 70 preferably assists in returning the switch to an open position after an actuating force is removed, protects the switch from atmospheric conditions, and absorbs excessive actuating forces. The sleeve 70 may be formed of silicone rubber or other resilient material. It should be apparent that the exterior peripheral shape of the sleeve 70 many be squared, oval, or any other suitable shape that may accommodate the contour of the actuating spring 18. For example, the portion of the sleeve that comes into contact with the face of the spring 18** may be flattened slightly to provide a greater contact area.

Figure 2:
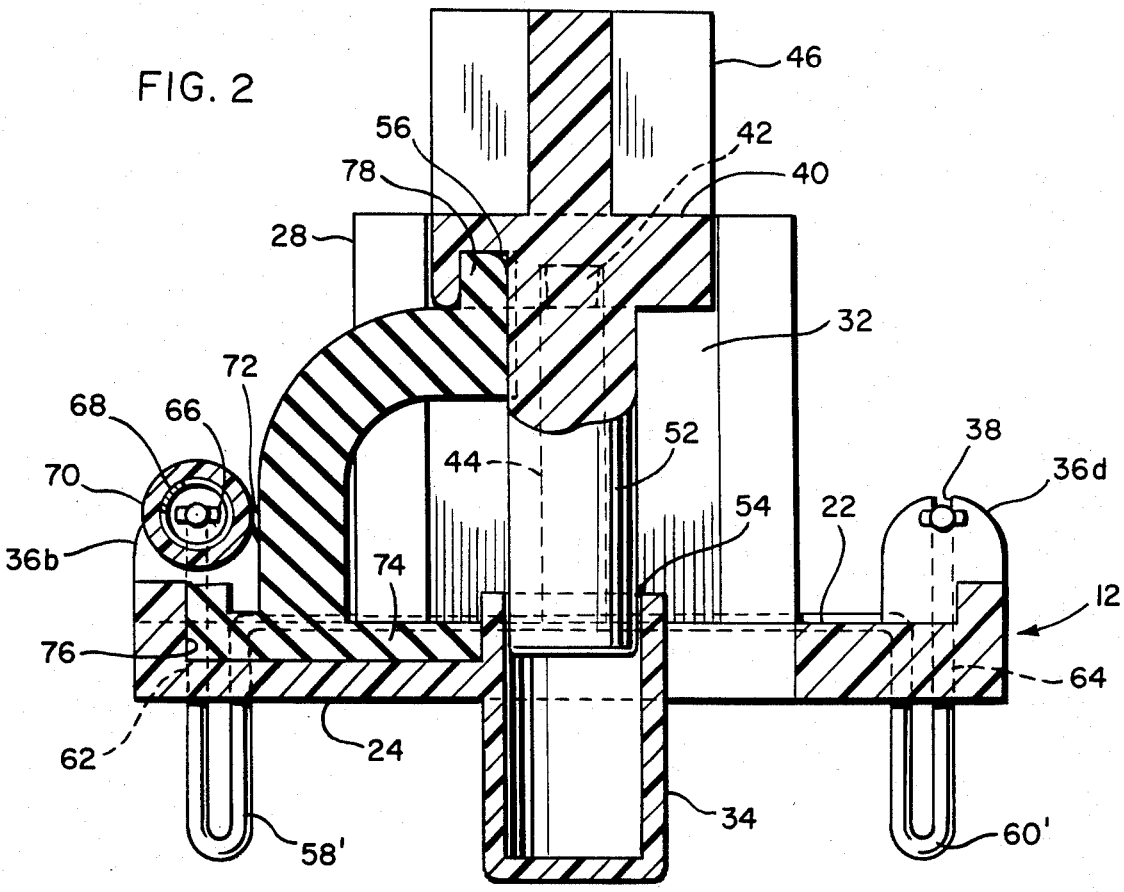
FIG. 2 is a section on line 2—2 of FIG. 1.
Figure 3:
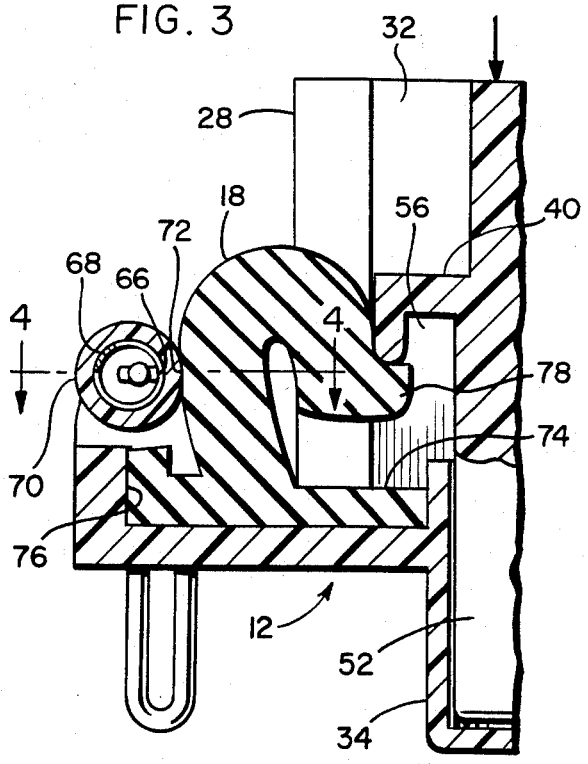
FIG. 3 is a partial section on line 2—2 of FIG. 1 of the switch assembly in a closed position.

Positioned adjacent the resilient sleeve 70 is an actuating spring 18 formed of a single piece of resilient material, preferably a rubber material or equivalent rubber-like material. The rubber spring 18 includes a substantially planar frontal surface 72 integral with a base portion 74 that is snugly retained, or captured within, a recess 76 disposed within the planar base 12. The opposite end of the rubber spring forms a retaining lip 78 that is engaged by the groove 56 defined by the plunger guide element 40. The retaining lip 78 is freely retractable from the groove 56 when the switch is in its closed position, as shown in FIG. 3, and returns into the groove 56 when the switch returns to its normally open position, as shown in FIG. 2. The substantially planar face 72 of the spring 18 is positioned adjacent to, and extends along the length of, the resilient sealing sleeve 70. Preferably, the width of the rubber spring 18 is sufficiently wide to overlie the contact surfaces 66 of the wire conducting members. By making the rubber spring 18 sufficiently wide, the switch actuating force is increased and is applied normal to the contact surfaces, thus providing a positive contact between the contact surfaces and the contactor member. Moreover, the actuating force will be applied along a substantial length of the resilient sleeve 70. This minimizes wear on the sleeve.

The actuating spring 18 is preferably made of rubber, although other resilient rubber-like materials may be used. The rubber is formed by an extrusion, extruded in a direction along the width of the rubber spring and then sliced off in suitable widths. Generally, the greater the width of the rubber spring 18, the greater the spring force.

The rubber spring 18 is connected between the base 12 and the plunger guide 40 and is bent back away from the sealing sleeve 70, in a manner as shown. In certain circumstances, the rubber may be molded in a bent configuration so as not to be in a prestressed condition when mounted in the base. Upon actuation of the plunger 20 in a switch actuating direction, i.e., downward through the top planar surface 22 of the base 12, the rubber spring 18 bends double as shown in FIG. 3, and laterally deflects in a substantially radial direction with respect to the wire conducting members 14, 16. Force is thus transmitted from the spring 18, when biased as shown in FIGS. 3 and 4, through the resilient sleeve 70 and to the cylindrical contactor member 68 to move the sleeve 70 and contactor member 68 into a switch-actuating position whereby the contactor member 68 bridges the contact surfaces 66 of the wire conducting members 14, 16. Since the contact surfaces 66 are preferably curvilinear, and since the contactor member 68 is preferably formed from a cylindrically wound wire, the wound wire contacts the contact surface at a generally singular point (as best shown in FIG. 4) which provides a desirably large contact pressure.

Although it appears that the contactor tube 68 moves in a substantially radial direction into engagement with the outwardly facing contact surfaces 66, the application of the spring force may be slightly angled depending upon the exact positioning and configuration of the rubber spring 18. As such, the contactor member 66 may roll slightly over the contact surfaces 66. This is desirable since it provides a self-cleaning of the switch contact surfaces vis-a-vis the interior of the contactor tube.

When the plunger 20 is released, the switch will return to its open condition. This occurs as a result of the resiliency of both the sealing sleeve 70 and the rubber spring 18. Moreover, the rubber spring 18 aids the sealing sleeve 70 in absorbing large application forces, thus avoiding damage to the switch contacts. Further, the rubber spring 18, due to its resiliency and due to its relatively large surface area, does not provide relatively localized forces on the sealing tube 70, thus enabling the sealing tube to wear minimally.

It should be appreciated that the rubber-like spring actuator 18 may have applicability in actuating or closing switch contacts of various configurations. For example, with suitable modification, the spring actuator 18 may be adapted to transmit actuating forces to switch contacts of the type shown in U.S. Pat. No. 4,488,317.

Figure 6:
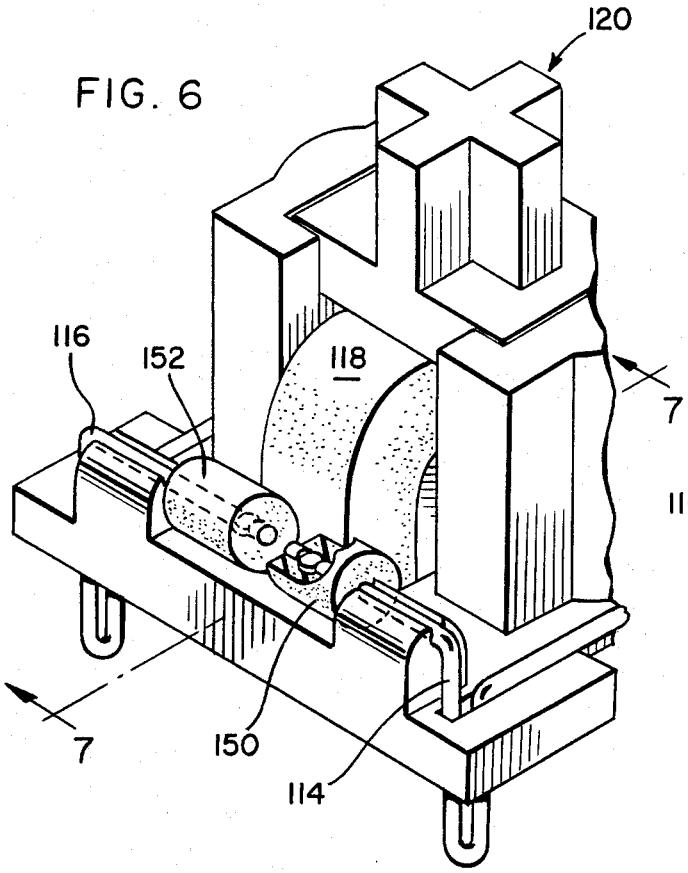
FIG. 6 is a perspective view of an alternative switch assembly embodiment.
Figure 7:
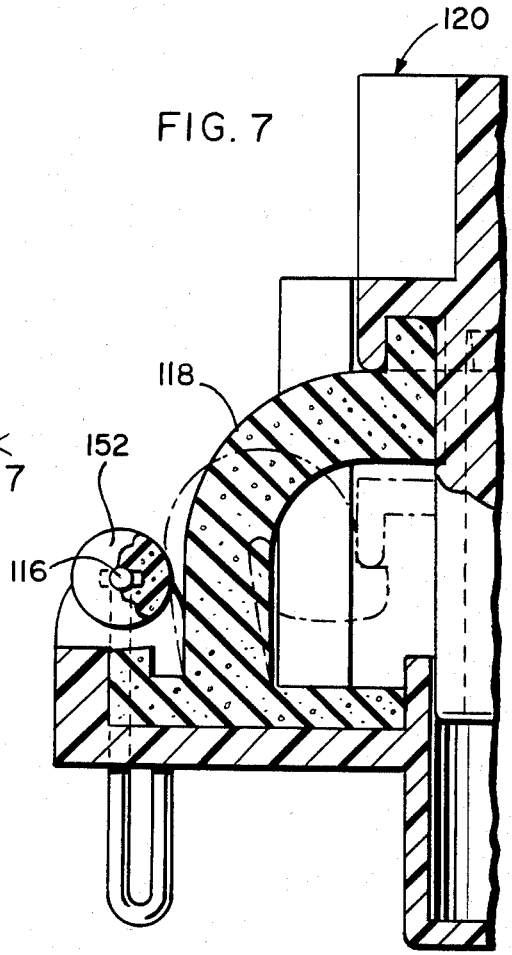
FIG. 7 is a partial section view on line 7—7 of FIG. 6.

An alternative embodiment of the present invention is depicted in FIGS. 6–7. In this embodiment, the support base, plunger, and wire conducting members are identical to that of the above-described embodiment and need not be further discussed. In this embodiment, however, positioned at the ends of the collinearly aligned conducting members 114, 116 are a pair of spaced apart cylindrical conductive rubber sleeves 150, 152 that are frictionally engaged with the conducting member end portions. This frictional engagement results from the swaged wire ends frictionally restraining the conductive rubber sleeves in position. The rubber-like spring 118 of this embodiment is of substantially identical configuration to the above-described embodiment but is formed of conductive rubber. When the manually actuatable plunger 120 is depressed in a downward direction, the conductive rubber spring 118 deforms or deflects, in the same manner as described with respect to the embodiment of FIGS. 1–4, into contact with the cylindrical surfaces of the conductive rubber sleeves 150, 152, thus bridging the sleeves and closing the switch. When the manually actuatable plunger 120 is released, the resiliency of the conductive rubber spring 118, assisted by the resiliency of the conductive rubber sleeves 150, 152, provides a return force to automatically open the switch contacts.

Various conductive rubber or rubber-like materials may be used. Although conductive rubber is generally susceptible to wear, nevertheless it provides cost savings that may be justified in certain environments. Conductive rubber is generally less expensive. Moreover, the wire conducting members, particularly at the contact surfaces, do not need to be plated which results in a cost saving.

Another embodiment of the present invention is depicted in FIGS. 8–9. In this embodiment, the support base, plunger, and wire conducting members are identical to that of the above-described embodiment. In this embodiment, the wire conducting members 214, 216 define contact surfaces 266 which face outwardly from the circumference or periphery of the wire conductors. The rubber-like spring 218 is of substantially identical configuration to the above embodiments, but is formed of non-conductive rubber, or rubber-like material, (as in the embodiment of FIGS. 1–5) and includes a groove or notch 280 extending along the width of the spring 218, substantially parallel with the conducting members 214, 216. Frictionally restrained within the spring notch 280 is an electrically-conductive rod, or bar, 282. When the spring is biased, or actuated, by the plunger 220, the rubber-like spring 218 deforms, or deflects, such that the conductive rod 282 (preferably of metallic or conductive rubber material) contacts the contact surfaces 266 to thus bridge the contact surfaces to close the switch.

It should be apparent that the rubber-like spring 218 with the conductive rod 282 disposed within the spring face, could also be used in the embodiments of FIGS. 6–7. That is, the spring 218 could be positioned adjacent the cylindrical conductive rubber-like sleeves 150, 152 such that deformation of the spring 218 results in contact between the sleeves 150, 152 with the conductive rod 282 to cause a closing of the switch.

Similarly, the conductive rubber-like spring 118 of the embodiment of FIGS. 6–7 could be used as a substitute for the spring 218 in the embodiment of FIGS. 8–9. That is, the conductive rubber-like spring 118, having a planar conductive surface, could be positioned adjacent the conducting members 214, 216 such that deformation of the spring 118 results in contact between the conducting surfaces 266 with the planar face of the spring 118 to cause a closing of the switch.

It should be appreciated that the switch embodiments of the present invention are extremely uncomplicated and operate in an efficient manner with a minimum of moving parts. While the switch may find applicability primarily in keyboard applications, it should be recognized that the present invention may be utilized in a multitude of switch environments other than keyboard applications. For example, a switch of the same overall geometry, yet substantially larger, might be used in a power switching environment.

Still further, it should be recognized that the switch contact components and the spring actuator may have independent utility. For example, the switch contact members and the contactor tube may be actuated by a rigid actuator or even by a non-mechanical actuator. For example, the contacts may be closed by the application of a magnetic force across the switch assembly similar to that described in U.S. Pat. No. 4,433,317.

It is to be understood that the switch constructions of the embodiments of the invention herein shown and described must be taken only as preferred representations of the invention. Various changes and modifications in the arrangement of the components, parts, units, elements, etc., may be resorted to without departure from the disclosure of the invention or the scope of the appended claims.

I claim:

1. A switch comprising:

a base;

a pair of wire conducting members secured to said base substantially collinear to each other with the ends thereof spaced apart, each said wire conducting member including a contact surface facing outward from the circumference of the wire conducting member;

an elongated contactor member, having a length at least as great as the distance between the contact surfaces of the wire conducting members, and disposed radially outward from, and in facing relationship with, the contact surfaces;

a resilient sleeve enclosing the contact surfaces and the spaced-apart ends of the wire conducting members, and encircling and supporting said elongated contactor member;

actuator means associated with said base to apply force through said resilient sleeve to said contactor member to displace said contactor member and said resilient sleeve to effect a closing of the contact surfaces by the contactor member.

2. A switch as claimed in claim 1 wherein said elongated contactor member is cylindrical and surrounds the pair of wire conducting members in spaced relationship thereto such that the interior surface of said cylindrical contactor member is in facing relationship with the contact surfaces of each wire conducting member.

3. A switch as claimed in claim 2 wherein said cylindrical contactor member is a cylindrically wound wire.

4. A switch as claimed in claim 2 wherein the contact surface of each wire conducting member is displaced radially outwardly from the circumference of the wire conducting member.

5. A switch as claimed in claim 4 wherein the contact surface of each wire conducting member is formed by swaging the wire conducting member at a location spaced from the end of the wire conducting member.

6. A switch as claimed in claim 2 wherein said cylindrical contactor member is force-fit within said resilient sleeve.

7. A switch as claimed in claim 2 wherein said resilient sleeve defines an inner cylindrical wall having a diameter substantially less than the outer diameter of said cylindrical contactor member such that the cylindrical contactor member is frictionally restrained within the sleeve.

8. A switch as claimed in claim 2 wherein said actuator means comprises a spring associated with said base adjacent to said resilient sleeve, and biasing means for biasing the spring into force-transmitting engagement with said resilient sleeve.

9. A switch as claimed in claim 8 wherein said spring comprises a resilient member and said biasing means is coupled with said resilient member for deflecting said resilient member in a direction generally radially of said resilient sleeve.

10. A switch as claimed in claim 9 wherein said resilient member comprises a rubber-like strip having a planar face, one end of said rubber-like strip coupled with said base, the other end of said rubber-like strip coupled with said biasing means, such that the planar face or said rubber-like strip lies substantially parallel with said resilient sleeve.

11. A switch as claimed in claim 10 wherein said biasing means comprises a plunger reciprocally mounted to said base, said other end of said rubber-like strip coupled with said plunger such that movement of said plunger in a direction toward the base deflects the resilient member into force-transmitting contact with said resilient sleeve.

12. A switch as claimed in claim 1 wherein each wire conducting member extends through said base at two distinct locations to define at least two terminals adapted for connection with a circuit board.

13. A switch comprising:

a base;

a pair of elongated conducting members secured to said base substantially collinear to each other with the ends thereof spaced apart to define a pair of contact surfaces;

a contactor member disposed in facing relationship with said contact surfaces;

a cylindrical sleeve enclosing the contact surfaces and the spaced-apart ends of the conducting members, and encircling and supporting said contactor member;

actuating spring means associated with said base adjacent to said cylindrical sleeve for providing a spring force through said cylindrical sleeve to said contactor member to displace said contactor member into bridging contact across the contact surfaces of the conducting members; and biasing means associated with said base for biasing said spring means into force-transmitting engagement with said cylindrical sleeve.

14. A switch as claimed in claim 13 wherein said biasing means comprises a manually-actuatable plunger reciprocally mounted to said base, said plunger connected with said spring means to apply a bias thereto upon movement of said plunger.

15. A switch as claimed in claim 14 wherein said spring means comprises a resilient member defining a planar surface, said planar surface situated adjacent to, and substantially parallel with, said cylindrical sleeve.

16. A switch as claimed in claim 15 wherein said resilient member is a rubber-like strip, one end connected with said base, the other end connected with said plunger, whereby movement of said plunger in a switch-actuating direction distorts the rubber-like strip so as to laterally deflect the planar face of said strip into force-transmitting engagement with said cylindrical sleeve.

17. A switch as claimed in claim 14 wherein said base is a substantially planar member and said plunger is mounted in upstanding guideways extending from one planar surface of said planar base.

18. A switch as claimed in claim 17 wherein said plunger includes a locating rod accommodated within a rod guideway extending from the opposite planar surface of said base.

19. A switch comprising:

a base;

a pair of elongated wire conducting members secured to said base substantially collinear to each other with the ends thereof spaced apart;

a pair of resilient electrically-conductive sleeves, each sleeve secured to a wire conducting member along the length thereof and spaced apart from each other;

resilient electrically-conductive spring means associated with said base adjacent to said spaced-apart conductive sleeves; and biasing means associated with said base for biasing said conductive spring means into contact with said conductive sleeves.

20. A switch as claimed in claim 19 wherein said conductive sleeves are cylindrical.

21. A switch as claimed in claim 20 wherein the outer diameter of each said cylindrical conductive sleeve is substantially greater than the diameter of the wire conducting members.

22. A switch as claimed in claim 20 wherein said conductive sleeves are conductive rubber.

23. A switch as claimed in claim 20 wherein said spring means comprises a resilient electrically-conductive member defining a planar surface, said planar surface situated in facing relationship to, and substantially parallel with, said cylindrical sleeves.

24. A switch as claimed in claim 23 wherein said electrically-conductive member is an electrically-conductive rubber-like strip, one end connected with said base, the other end connected with said biasing means, whereby said rubber-like strip may be biased to laterally deflect the planar face of said strip into contact with said cylindrical sleeves.

25. A switch comprising:

a base;

a pair of elongated conducting members secured to said base substantially collinear to each other with the ends thereof spaced apart, each conducting member including a contact surface along at least a portion of the length of the conducting member and facing in an outward direction from the conducting member;

resilient spring means associated with said base adjacent to said contact surfaces of said conducting members, said spring means connected with said base and with a biasing means, said spring means including an electrically-conductive portion bridging said contact surfaces when biased by said biasing means; and said biasing means connected with said resilient spring means for biasing said resilient spring means in a direction such that the electrically-conductive portion of said spring means bridges said contact surfaces when a force is applied to said biasing means.

26. A switch as claimed in claim 25 wherein said contact surface of each conducting member is defined by the periphery of the conducting member.

27. A switch as claimed in claim 25 wherein said contact surface of each conducting member is defined by the circumferential periphery of a resilient electrically-conductive sleeve secured to said conducting member.

28. A switch as claimed in claim 25 wherein said resilient spring means comprises a resilient electrically-conductive rubber-like strip wherein said electrically-conductive portion is defined by a planar surface of said strip in facing relationship to said contact surfaces of the conducting members.

29. A switch as claimed in claim 25 wherein said resilient spring means comprises a resilient rubber-like strip defining a substantially planar surface and wherein said electrically-conductive portion is defined by an electrically-conductive member affixed to said planar surface in facing relationship with the contact surfaces of the conducting members.

* * * * *